US012419367B2

(12) United States Patent
Hering

(10) Patent No.: US 12,419,367 B2
(45) Date of Patent: Sep. 23, 2025

(54) CLOTHING SYSTEM

(71) Applicant: Waltraud Hering, Leipzig (DE)

(72) Inventor: Monty Hering, Stahlgruberring (DE)

(73) Assignee: Waltraud Hering, Leipzig (DE)

( * ) Notice: Subject to any disclaimer, the term of this patent is extended or adjusted under 35 U.S.C. 154(b) by 12 days.

(21) Appl. No.: 18/204,454

(22) Filed: Jun. 1, 2023

(65) Prior Publication Data

US 2023/0380522 A1 Nov. 30, 2023

Related U.S. Application Data

(63) Continuation of application No. PCT/DE2021/000189, filed on Dec. 2, 2021.

(51) Int. Cl.

| | |
|---|---|
| ***A41D 13/05*** | (2006.01) |
| ***A41D 31/10*** | (2019.01) |
| ***A41D 31/24*** | (2019.01) |
| ***F41H 1/02*** | (2006.01) |

(52) U.S. Cl.

CPC ..... *A41D 13/0518* (2013.01); *A41D 13/0575* (2013.01); *A41D 31/10* (2019.02); *A41D 31/24* (2019.02); *F41H 1/02* (2013.01)

(58) Field of Classification Search

CPC ..... A41D 13/0518; A41D 13/0575; A41D 31/10; A41D 31/24; A41D 13/0556; A41D 13/0562; A41D 13/0568; F41H 1/02

See application file for complete search history.

(56) References Cited

U.S. PATENT DOCUMENTS

| | | | | | |
|---|---|---|---|---|---|
| 4,485,491 | A * | 12/1984 | Rasmussen | F41H 1/02 | 2/2.5 |
| 4,507,802 | A * | 4/1985 | Small | F41H 1/02 | 2/2.5 |
| 5,054,127 | A * | 10/1991 | Zevchak | A41D 27/20 | 2/250 |
| 5,157,792 | A * | 10/1992 | Allen | F41H 1/02 | 2/92 |
| 5,592,689 | A * | 1/1997 | Matthews | A41D 13/0562 | 2/24 |

(Continued)

FOREIGN PATENT DOCUMENTS

| | | |
|---|---|---|
| DE | 202017005368 | 12/2017 |
| IT | 20130053 | 12/2014 |

OTHER PUBLICATIONS

PCT/DE2021/000189 International Search Report dated Dec. 2, 2021.

PCT/DE2021/000189 Written Opinion dated Dec. 2, 2021.

*Primary Examiner* — Khaled Annis

(74) *Attorney, Agent, or Firm* — Ralphe E. Jocke; WALKER & JOCKE

(57) ABSTRACT

Exemplary arrangements relate to a clothing system that comprises a plurality of clothing items (1, 2, 3). Each of the clothing items is configured to be worn simultaneously in layered relation with at least one of the other clothing items. Each of the clothing items includes at least one hold device (5, 6, 7). Each hold device is configured to releasably hold a protective textile item (4) in engagement with the respective clothing item. One or more protective textile items in engaged relation with the respective clothing item provides one or more desired properties suitable for addressing environmental or occupational conditions.

20 Claims, 9 Drawing Sheets

(56) References Cited

U.S. PATENT DOCUMENTS 5,621,914 A 4/1997 Ramone et al.
5,636,377 A * 6/1997 Wiener ..... A41D 13/1254 2/2.5
5,960,470 A * 10/1999 Bachner, Jr. ..... F41H 1/02 2/2.5
6,009,565 A * 1/2000 Carrington ..... A41D 13/015 2/455
6,766,529 B1 * 7/2004 Nathan ..... F41H 1/02 2/2.5
8,505,122 B1 * 8/2013 Green ..... A41D 13/0156 2/463
10,094,640 B2 * 10/2018 Aquino ..... F41H 5/0471
10,401,125 B2 * 9/2019 Howland ..... A41D 1/02
10,694,793 B2 * 6/2020 West ..... D04B 1/16
11,157,979 B1 * 10/2021 Arenas ..... B33Y 10/00
2005/0081277 A1 * 4/2005 Matechen ..... A41D 13/0518 2/102
2006/0143763 A1 * 7/2006 Dawson ..... F41H 1/02 2/2.5
2007/0139875 A1 * 6/2007 Carstens ..... G06F 1/163 361/679.01
2008/0040831 A1 * 2/2008 Nilforushan ..... A61F 7/02 219/211
2008/0201818 A1 * 8/2008 Nilforushan ..... A61F 7/02 607/114
2009/0151036 A1 * 6/2009 Joseph ..... F41H 1/02 2/243.1
2010/0024089 A1 * 2/2010 Turner ..... A41D 13/05 2/243.1
2010/0024100 A1 * 2/2010 Sokolowski ..... A41D 13/0562 2/455
2011/0131694 A1 * 6/2011 Fearon ..... F41H 1/02 2/2.5
2011/0185463 A1 * 8/2011 Weber ..... F41H 1/02 2/2.5
2011/0185464 A1 * 8/2011 Weber ..... F41H 5/0485 2/2.5
2012/0047630 A1 * 3/2012 Gare ..... A41D 27/08 2/244
2012/0216327 A1 * 8/2012 Turner ..... A41D 13/0593 2/69
2013/0152290 A1 * 6/2013 Chou ..... A41D 13/0575 2/463
2013/0318671 A1 * 12/2013 Haider ..... F41H 1/02 2/2.5
2015/0211829 A1 * 7/2015 Cole ..... F41H 1/02 2/463
2016/0273882 A1 * 9/2016 Coats ..... G01N 3/313
2017/0156415 A1 * 6/2017 Winner ..... A41D 13/1245
2017/0196277 A1 7/2017 Henry et al.
2018/0160744 A1 * 6/2018 Blauer ..... F41H 1/02
2018/0271186 A1 * 9/2018 Milling ..... A41D 13/0543
2018/0372452 A1 * 12/2018 MacNeil ..... F41H 1/02
2019/0041169 A1 * 2/2019 Wilker ..... F41H 5/04
2022/0290945 A1 * 9/2022 Blauer ..... A41D 13/0518
2023/0276871 A1 * 9/2023 Brown ..... A41D 13/0531 2/462
2023/0380522 A1 * 11/2023 Hering ..... A41D 13/0568

* cited by examiner

CLOTHING SYSTEM

TECHNICAL FIELD

Exemplary arrangements relate to a clothing system. Exemplary arrangements relate to a clothing system including a plurality of clothing items, each of which is configured to be worn in overlying relation of the same human body portion, and each of which is configured to be worn simultaneously in layered relation with at least one of the other clothing items.

BACKGROUND

Clothing is often produced to provide comfort and/or style. Often a person will want to wear several layers of clothing over the same body portion to provide enhanced comfort. This may be done for example to provide several layers of clothing over the same body portion to keep the person warm when out-of-doors during cold weather. A person may also want to add or remove layers of clothing as they move between warmer and colder surroundings.

Some clothing items are made to have a protective item selectively releasably attached thereto such as a stab or cut resistant attachment. Such an attachment can be installed or removed as the wearer feels may be necessary depending on whether the person feels that may be exposed to a stabbing or cutting risk.

Existing clothing systems may benefit from improvements.

SUMMARY

Exemplary arrangements relate to a clothing system that includes a plurality of clothing items each of which is configured to be worn in overlying relation of the same human body portion. In exemplary arrangements each of the clothing items is configured to be worn simultaneously in layered relation with at least one of the other clothing items. In some arrangements each clothing item is configured to be worn in layered relation with a plurality of other clothing items as well as independently of the other clothing items.

The exemplary clothing system further includes a protective textile item. The protective textile item is made to have at least one property that is desirable for a clothing item that is worn in particular situations or by persons in a particular occupation. For example the at least one protective textile item may be stab resistant, bullet resistant, water resistant, waterproof or windproof. Other exemplary protective textile items may be flame resistant, heat resistant, radiation reflecting or have other desirable properties. Still other exemplary protective textile items may generate heat or provide other desired environmental properties.

In the exemplary clothing system each clothing item includes at least one hold device. The respective at least one hold device of the respective clothing item is configured to releasably engage the protective textile item with the clothing item. In exemplary systems the protective textile item is configured to be engaged with the at least one hold device on any one of the clothing items that are currently being simultaneously worn by the person. This enables the person to selectively engage the protective textile item so that it is either attached to an outermost clothing item or attached to an innermost clothing item, for example. Similarly in some arrangements a person may selectively engage the protective textile item with a clothing item that is layered internally of an outer clothing item. This enables the person to remove the outer clothing item and still receive the benefit of the protective textile item remaining engaged with the inner clothing item.

Numerous features, relationships, configurations and approaches may be utilized in exemplary clothing systems to provide a wearer of the clothing items with desired properties and/or beneficial features.

DETAILED DESCRIPTION

Figure 1:
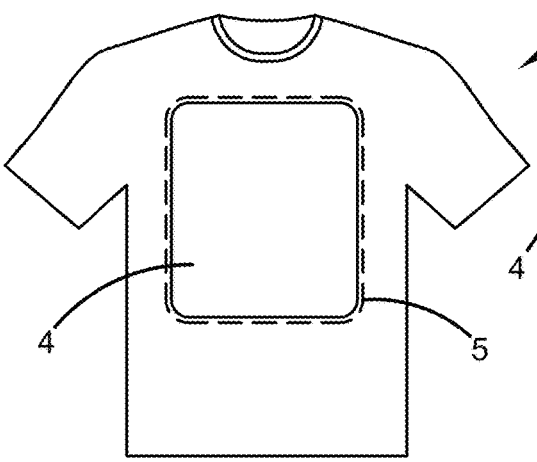
FIGS. 1-3 each show a respective exemplary clothing item which is included as part of a clothing system.

Referring now to the drawings and particularly to FIGS. 1-4, there is shown therein the components of an exemplary clothing system. The clothing system includes three clothing items, which in this case are items that are configured to cover in overlying relation the upper body portion of a person wearing the item including the wearer's chest 26. In this exemplary arrangement the first clothing item is a T-shirt 1. The second clothing item is a long sleeve shirt 2. The third clothing item is a hooded pullover 3. In the exemplary arrangement each of these clothing items is configured to be worn individually as shown in FIGS. 1A, 2A and 3A, respectively. However, each of these clothing items is also configured to be worn by a person simultaneously with another one of the clothing items of the system in layered relation such as with items 1 and 2 as shown in FIG. 2B. In this exemplary arrangement all three of the clothing items are configured to be worn simultaneously such as is represented in FIG. 3B. However in other exemplary systems each clothing item may be configured to be worn simultaneously in layered relation with at least one of the other clothing items of the system.

Figure 4:
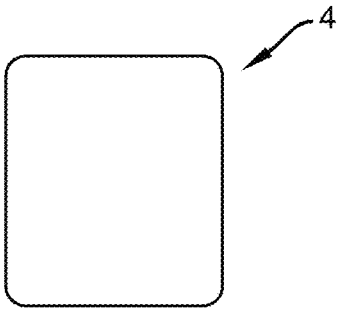
FIG. 4 shows an exemplary protective textile item that is a part of the clothing system.

This exemplary system further includes a protective textile item 4 which is shown in FIG. 4. A protective textile item is alternatively referred to herein as a protective textile component. Exemplary protective textile items are items which are suitable to be worn as part of clothing by having sufficient flexibility to accommodate body and clothing movement, but that have one or more particularly desirable properties that are not always present in normal clothing items. In exemplary arrangements the protective textile items are often comprised of at least some fiber materials. In some exemplary arrangements such fiber materials may include fibers that provide the protective textile item with a high degree of resistance to penetration by objects and projectiles. For example in some exemplary arrangements a protective textile item may include fibers such as Kevlar® which are stab and penetration resistant and/or bullet resistant.

Other protective textile items may be comprised of materials that provide other desirable properties such as being waterproof or windproof. Other forms of protective textile items may have desired heat transfer properties. This may include items with insulating properties or that include heat generating materials that provide warming. Other protective textile items may include heat absorbing materials to provide cooling. Other protective textile items may have other desirable properties for particular recreational activity or professional activity. This may include for example protective textile items that provide radiation reflecting capabilities such as reflection of thermal or ultraviolet radiation. Other protective textile items may include properties such as fire and flame resistance, resistance to penetration by insects, resistance to biological or chemical contaminants and other properties.

In exemplary arrangements each of the plurality of clothing items in the system include at least one hold device. The at least one hold device is configured to releasably hold the protective textile item in engagement with the clothing item. In exemplary arrangements the at least one hold device may be included in a respective member of the respective clothing item that is integral with the respective clothing item. This may be for example in some arrangements a member which comprises a front or rear panel of a jacket, shirt or pullover which may include the at least one hold device that is configured to releasably engage and hold the protective textile item.

In the exemplary clothing system the at least one holding device of the T-shirt 1 comprises a pocket 5. The exemplary pocket is integral in this exemplary arrangement with a front member of the T-shirt and is configured to receive and hold at least a portion of the protective textile item 4 therein. In this exemplary arrangement the pocket 5 extends on an inside surface of the respective member and includes at least one opening to an interior area of the pocket through which the protective textile item may be inserted and removed.

In some exemplary arrangements the pocket or a portion thereof may be comprised of a stretchable fabric material. In such exemplary arrangements the stretchable fabric material may be resilient in a manner that helps to hold the protective textile item within the interior area of the pocket. Further in some exemplary arrangements the pocket may be configured so that when the member of the clothing item which includes the pocket is in a generally flat position, the pocket bounds a generally rectangular interior area. In the exemplary clothing system arrangement including clothing items 1-3 and protective textile item 4, the protective textile item in a generally flat position is generally rectangular as shown in FIG. 4. As used herein generally flat means that a majority of the element having this configuration extends in a single plane. Generally rectangular when used herein means that the item having this property when viewed in either a front or rear view has a shape the majority of which falls within a rectangular peripheral boundary. Further in the exemplary arrangement the protective textile item 4 is rectangular but has rounded corner portions on all four corners. Of course this configuration is exemplary and in other arrangements other shapes and configurations may be used.

Figure 2:
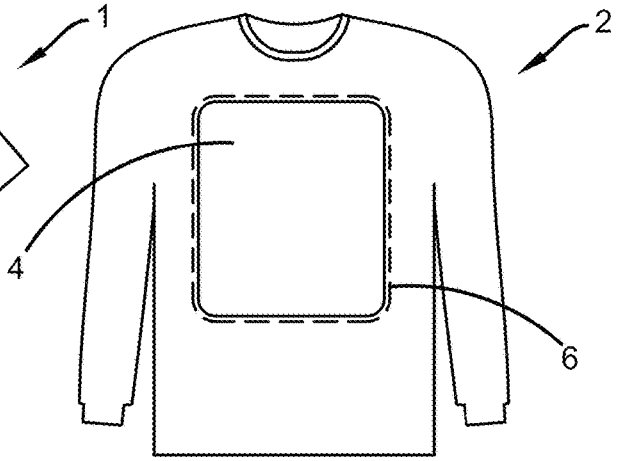
Figure 3:
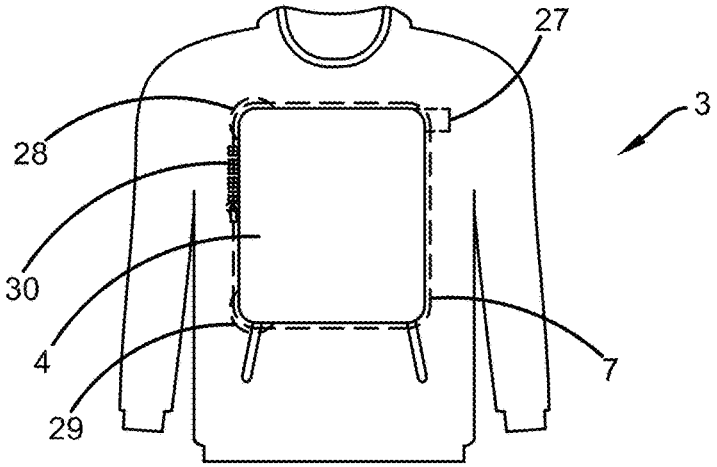
Figure 1A:
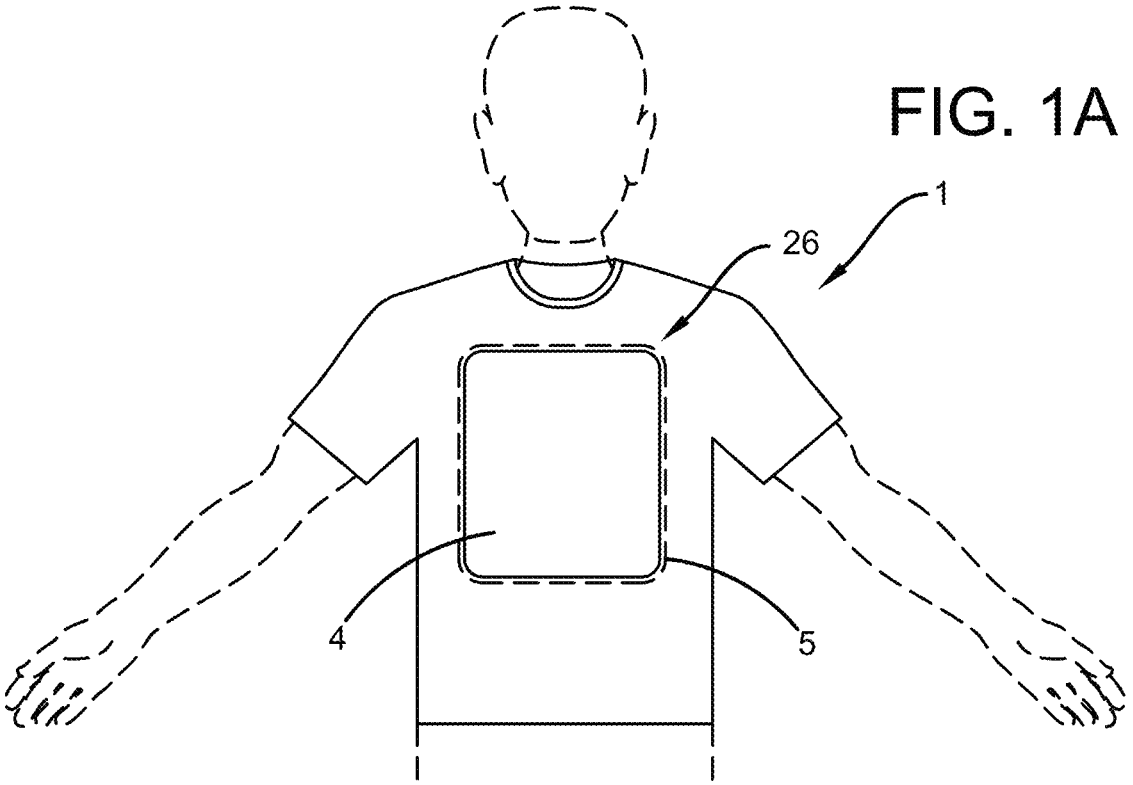
FIG. 1A shows the T-shirt of FIG. 1 worn by an individual and in overlying relation of the chest, back and shoulders of the individual.
Figure 2A:
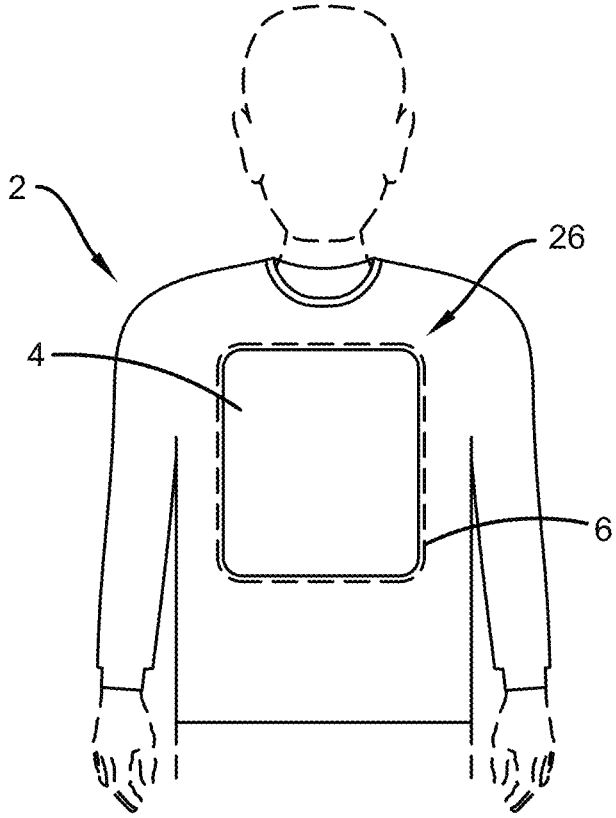
FIG. 2A shows the long sleeve shirt of FIG. 2 worn by an individual and in overlying relation of the chest, back and shoulders of the individual.
Figure 2B:
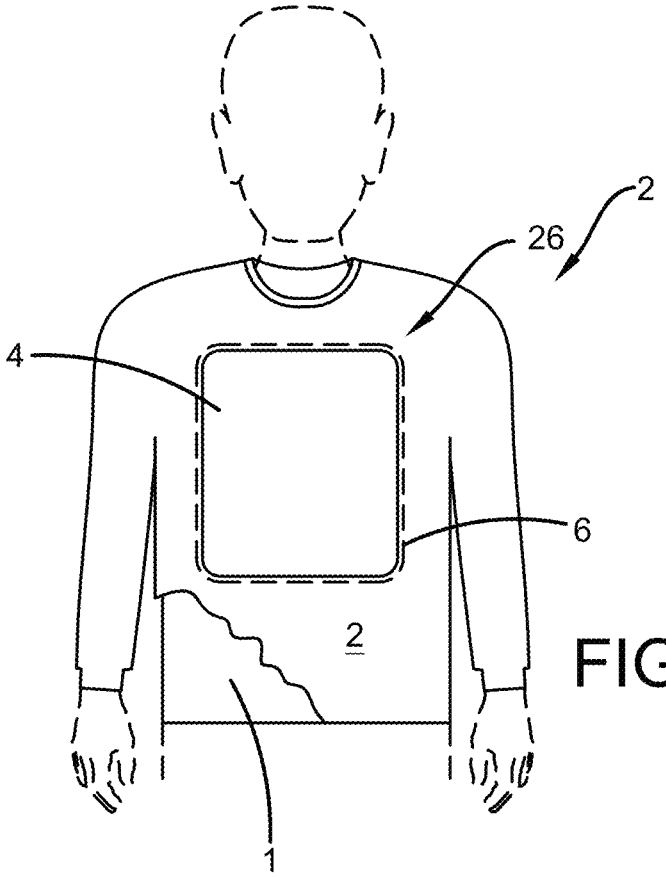
FIG. 2B shows the long sleeve shirt of FIG. 2 in overlying relation of the T-shirt of FIG. 1, and both of which being simultaneously worn by an individual in overlying relation of the chest, back and shoulders of the individual.
Figure 3A:
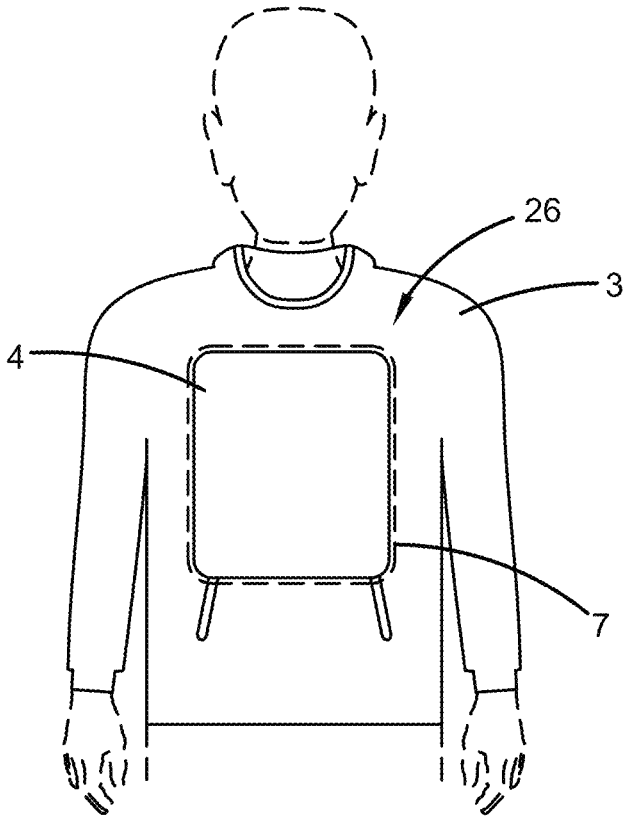
FIG. 3A shows the hooded pullover of FIG. 3 worn by an individual and in overlying relation of the chest, back and shoulders of the individual.
Figure 3B:
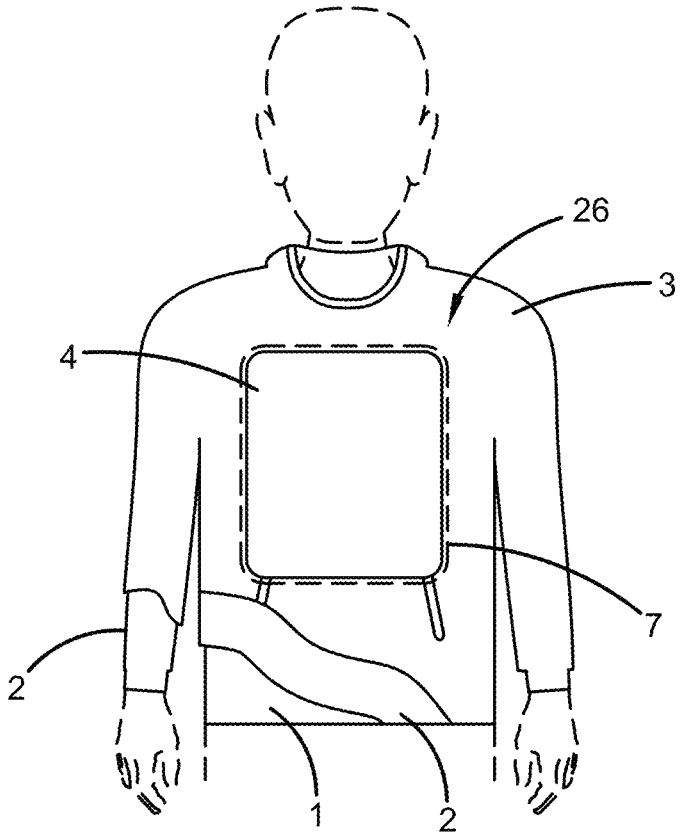
FIG. 3B shows the hooded pullover of FIG. 3 in overlying relation of the long sleeve shirt of FIG. 2, and the long sleeve shirt in overlying relation of the T-shirt of FIG. 1, and all of which being simultaneously worn by an individual in overlying relation of the chest, back and shoulders of the individual.

Further while the at least one hold device may comprise a respective pocket on the members of the clothing items shown in FIGS. 1-3, other hold devices may be used. In some exemplary arrangements the at least one hold device may be in permanently operatively engaged connection with the member of the clothing item while in other exemplary arrangements the at least one hold device may include multiple components some of which are in fixed operative connection with the clothing item and others of which are in fixed operative connection with the protective textile item.

Exemplary hold devices may include hook and loop fabric fasteners 27 such as Velcro® pads and straps shown schematically in FIG. 3. Other exemplary hold devices may include press studs 28 shown schematically in FIG. 3. As used herein press studs refers to a longitudinally extending member that is releasably engageable with another member by pressing the press stud and the other member together. In exemplary arrangements such press studs are releasable by pulling the press stud and engaging member apart. Press studs may also include snap to engage type connectors.

Other exemplary hold devices may include magnets 29 shown schematically in FIG. 3. Magnets which are engageable in attracting relation may be permanently engaged to each of the clothing item and the protective textile item. Other exemplary hold devices may comprise a zipper 30 shown schematically in FIG. 3. For purposes hereof a zipper will include all zippers of the types found on clothing articles as well as other types of zip fasteners that can be selectively actuated to engage mating components and to release engaged components. Of course it should be understood that numerous different types of hold devices may be used.

As shown in FIGS. 2 and 3 in the exemplary clothing system the long sleeve shirt 2 and the hooded pullover 3 each have at least one hold device that comprises a respective pocket 6, 7 configured to receive at least a portion of the protective textile item within the interior area of the pocket. However it should be understood that in other arrangements clothing items that are configured to be worn simultaneously in overlying relation may include different types of hold devices configured to releasably hold the same protective textile item.

In the exemplary arrangement, one, two or all three of clothing items 1-3 may be simultaneously worn by the user in overlying relation. In the exemplary arrangement regardless of the number of clothing items simultaneously being worn, the protective textile item may be engaged with only one of the clothing items as may be selected by the user. For example if all three of clothing items 1-3 are being simultaneously worn such as shown in FIG. 3B and the protective textile item 4 is a bullet resistant component, the user may choose to attach the protective textile item to any one of the inner layer clothing item 1, the middle layer clothing item 2 or the outer layer clothing item 3.

As can be appreciated in some circumstances the user may choose to engage the protective textile item with the inner clothing item. In this manner the user may choose to remove the outer clothing item and the middle clothing item, while still maintaining the protective textile item in place and functioning as a bullet resistant barrier for the wearer. Alternatively in some situations the user may choose to attach the protective textile item to an outer clothing item, so that the user can remove the bullet resistant barrier quickly and conveniently by removing the outer clothing item when the wearer no longer feels they have a risk of being in the path of bullets. Further as can be appreciated, in the exemplary clothing system the user has the option of disengaging the protective textile item from the one clothing item with which it is currently engaged, and thereafter engaging the protective textile item with another clothing item of the system which the wearer has or plans in the near future to put on. Of course it should be understood that these approaches are exemplary and in other arrangements other approaches may be used.

Further it should be understood that while in this first exemplary clothing system the exemplary clothing items all are configured to overlie the upper body portions of the user associated with the chest 26, back and shoulders, in other arrangements other types of clothing items may be used. These may include for example clothing items that cover the lower portion of the body. This may include clothing items in the form of trousers, undergarments, thigh, hip calf and other coverings.

Further while the exemplary clothing system has the protective textile item in a central location on the front of the user's chest 26, protective textile items may be positioned in numerous other locations. For example in other arrangements in which the clothing items are configured to overlie the upper areas of the wearer's body, the protective textile item may be positioned in a back member of the clothing item. Further in arrangements where the protective textile item is designed to be waterproof or resistant to solar radiation for example, the at least one clothing item may be configured so that the at least one hold device is operative to hold the protective textile item in upward overlying relation of the upper portion of the wearer's body such as above the shoulders. Of course it should be understood that these approaches are exemplary and in other arrangements other approaches may be used.

Figure 5:
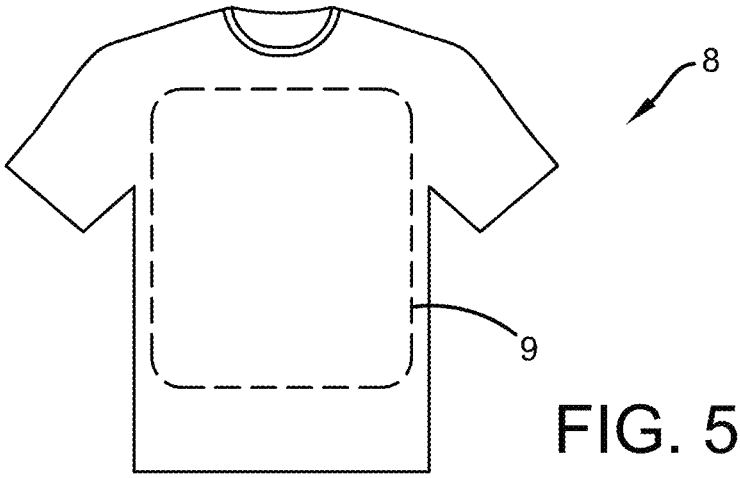
FIGS. 5-6 each show a respective exemplary clothing item that may be part of a clothing system.
Figure 6:
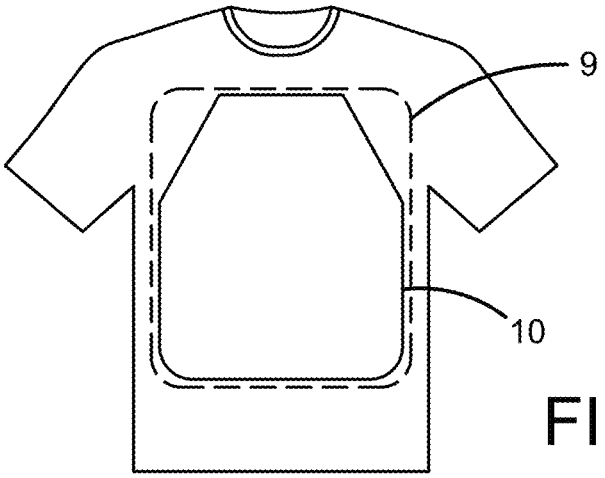
Figure 7:
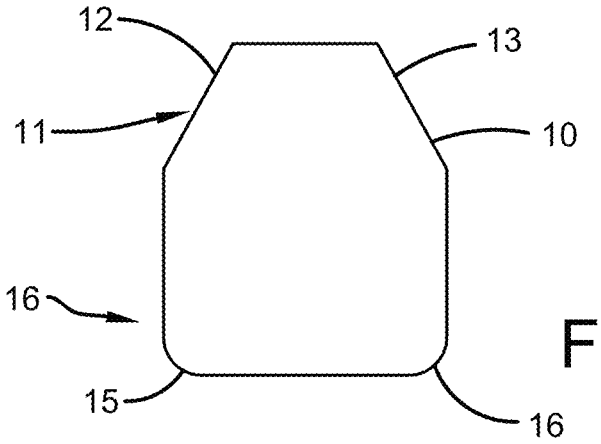
FIG. 7 shows an exemplary protective textile item that may be part of a clothing system.

Components of a further exemplary clothing item that may be used in a clothing system is shown in FIGS. 5-7. In this exemplary arrangement at least one clothing item comprises a T-shirt 8. In the exemplary clothing system the T-shirt 8 is configured to be worn in simultaneous layered relation with at least one other clothing item of the system in a manner similar to that of the initial clothing system previously discussed. The exemplary T-shirt 8 includes a hold device in the form of a sewn in pocket 9. In some exemplary arrangements the pocket 9 may be positioned so that it includes an interior area with an opening configured for receiving and removing a protective textile item from the pocket. In some exemplary arrangements the pocket may have the opening in the interior of the T-shirt while in other exemplary arrangements the opening may be on the exterior of the T-shirt. Further it should be understood that in some exemplary configurations the pocket may be in the member that comprises the front of the T-shirt while in other exemplary arrangements the pocket may be in the member that comprises the back, the top or other area of the T-shirt.

In the exemplary arrangement the protective textile item shown in FIG. 7 when generally flat, has a generally rectangular shape. In this exemplary arrangement of the protective textile item, the item has angled corner portions 12 and 13. The protective textile item 10 further has rounded corner portions 15 and 16. In the exemplary arrangement when the protective textile item is positioned in the pocket the rounded corner portions 15 and 16 are configured to be a lower portion 14 while the angled corner portions 12 and 13 are configured to be an upper portion 11 of the item. As can be appreciated in an exemplary arrangement where the opening to the interior area of the pocket 9 extends generally horizontally and is near the top of the pocket when the T-shirt is configured in the orientation in which it is normally worn by a person standing upright, the exemplary configuration of the at least one protective textile item makes it easier to insert and remove the protective textile item from the interior area of the pocket. Of course it should be understood that this configuration is exemplary, and in other arrangements other configurations of the protective textile item and the pocket or other hold devices may be used to meet the protective or other requirements of the clothing system.

Figure 8:
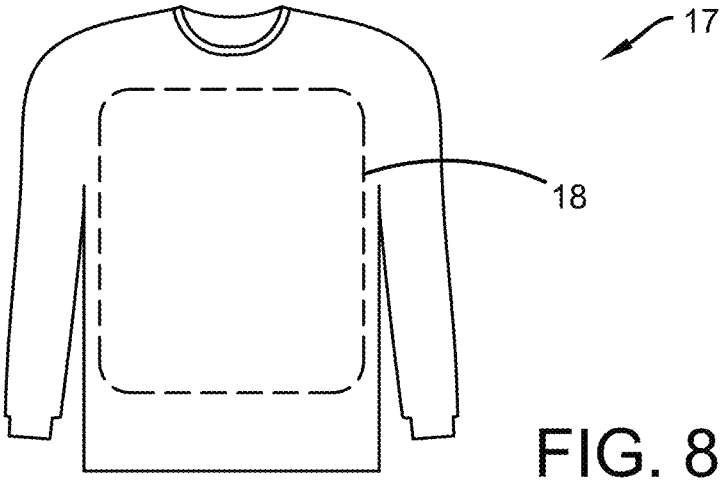
FIGS. 8-9 each show a respective exemplary clothing item that may be part of a clothing system.
Figure 9:
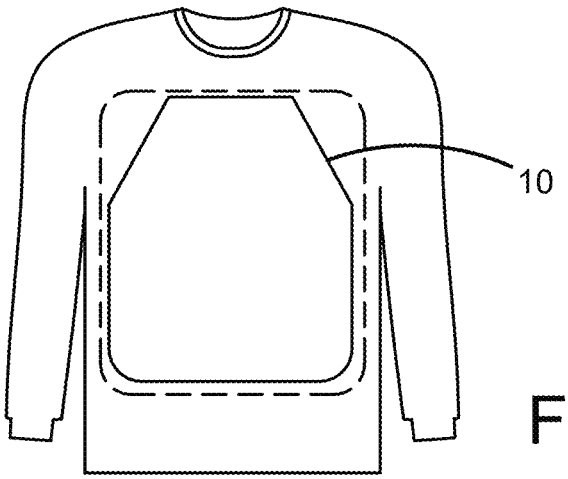
Figure 10:
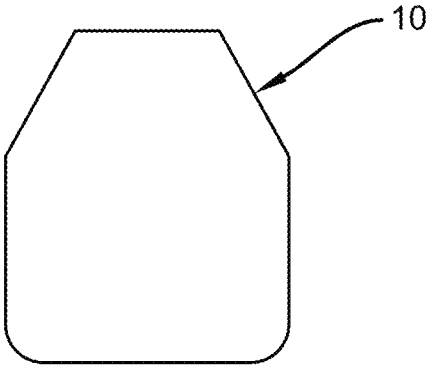
FIG. 10 shows an exemplary protective textile item that may be part of a clothing system.

FIGS. 8-10 show an exemplary long sleeve shirt 17 which may be used in an exemplary clothing system. Long sleeve shirt 17 includes at least one holding device 18 which is configured to releasably hold a protective textile item in engagement with the shirt. In this exemplary arrangement the holding device comprises a pocket similar to the pocket of T-shirt 8 which was previously discussed. The exemplary pocket of the long sleeve shirt 17 has a similar configuration to that of the T-shirt and is configured to releasably hold the protective textile item 10 previously described.

In this exemplary arrangement the long sleeve shirt 17 is configured to have the protective textile device 10 releasably engaged therewith as may be desired by the wearer. Thus in this exemplary arrangement the wearer may choose to wear simultaneously the T-shirt 8 and the long sleeve shirt 17 while having the protective textile item 10 engaged with the one clothing item that the wearer chooses to have engaged with the protective textile item.

Figure 11:
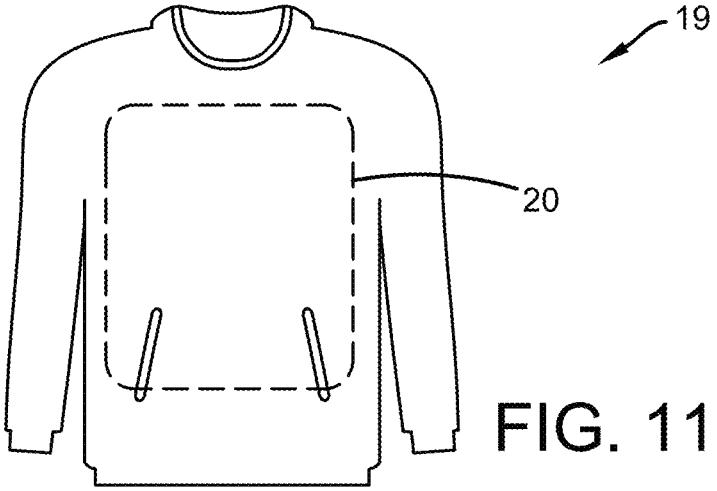
FIG. 11 shows an exemplary clothing item that may be part of an exemplary clothing system.
Figure 12:
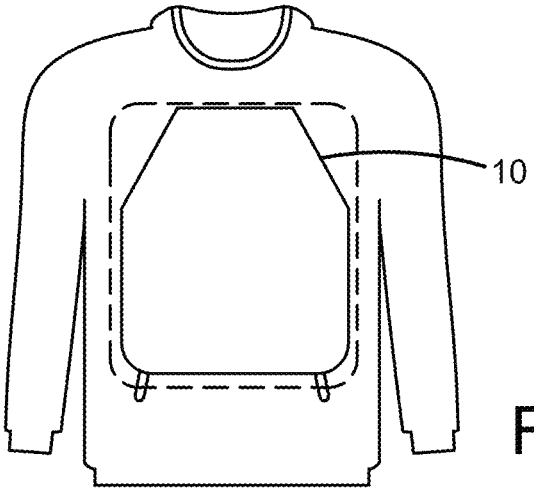
FIG. 12 shows the exemplary clothing item of FIG. 11 with a protective textile item positioned within a pocket of the clothing item.
Figure 13:
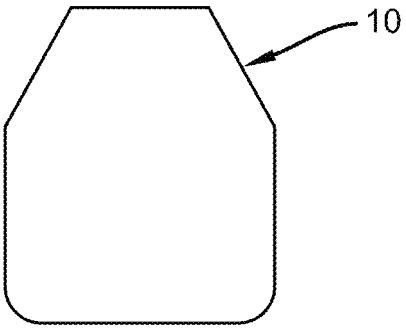
FIG. 13 shows the protective textile item of FIG. 12 shown separately from the clothing item.
Figure 14:
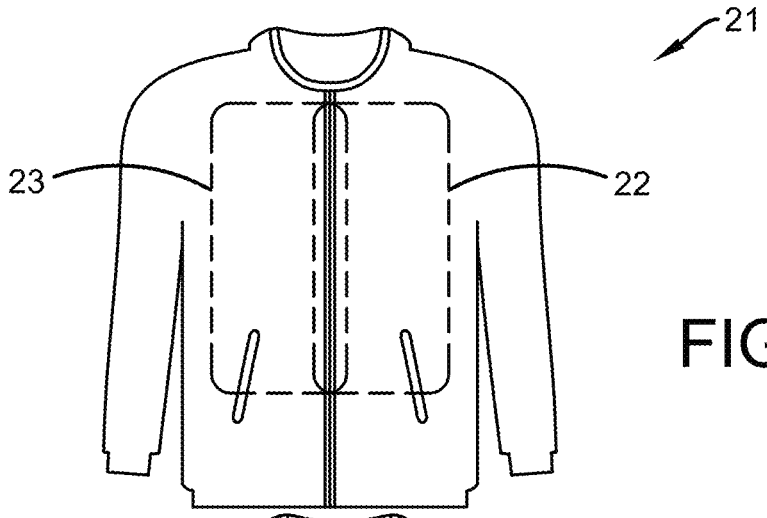
FIG. 14 shows an exemplary clothing item that may be part of an exemplary clothing system with one or more holding pockets that respectively serve as a hold device.
Figure 15:
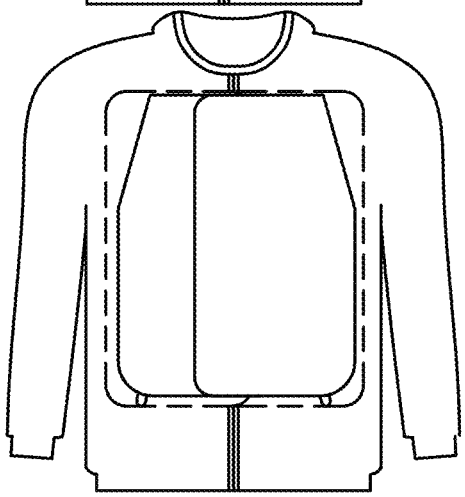
FIG. 15 shows the exemplary clothing item of FIG. 14 with at least one protective textile item positioned in the one or more holding pockets.
Figure 16:
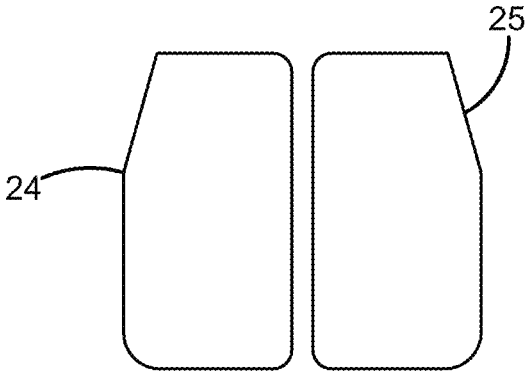
FIG. 16 and 17 show exemplary protective textile items which may be positioned in the respective one or more holding pockets of the clothing item of FIG. 14.
Figure 17:
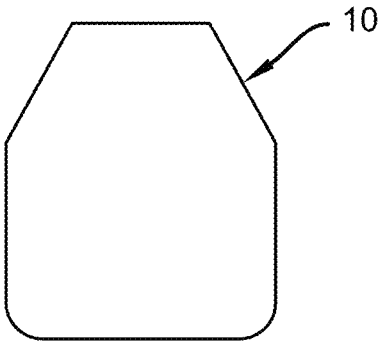

FIGS. 11-13 show an exemplary arrangement of a hooded pullover 19 that may be used in an exemplary clothing system. In this exemplary arrangement the hooded pullover includes at least one hold device 20. In this exemplary arrangement the hold device 20 comprises a pocket that is configured to releasably receive at least a portion of a protective textile item having the configuration of the previously discussed item 10. In this exemplary arrangement the protective textile item can be releasably engaged within the interior area of the pocket.

The exemplary hooded pullover 19 may be worn in simultaneous layered relation with one or both of the T-shirt 8 and the long sleeve shirt 17. Again as previously described the wearer may choose to have the protective textile item engaged with any respective one of the simultaneously worn clothing items.

FIGS. 14-17 show a further exemplary clothing item in the form of a jacket 21 which is alternatively referred to herein as a waistcoat, which may be used in a further exemplary clothing system. The exemplary jacket 21 has at least one hold device that is suitable for releasably engaging the previously described protective textile item 10. In this exemplary arrangement the at least one holding device comprises a pocket that is integral with a member of the jacket which extends across the back of the jacket. In this exemplary arrangement the protective textile item 10 is configured to be releasably positioned in the pocket and in engagement with the back member of the jacket.

Further in this exemplary arrangement the jacket 21 includes a pair of vertically divided front members which correspond to the respective front sides of the jacket. The respective front sides are releasably engageable via buttons, a zipper or other fasteners which a user may selectively engage and disengage to facilitate putting on and taking off the jacket. In this exemplary arrangement the respective front members which correspond to the jacket front sides include a respective at least one hold device 22 which is positioned on the left front side of the wearer and at least one hold device 23 which is positioned on the right front side of the wearer.

In this exemplary arrangement a protective textile device 24 is configured to be releasably engaged with the at least one hold device 23. In this particular exemplary arrangement the at least one hold device comprises a pocket with an interior area in which the protective textile device 24 may be positioned. A further protective textile device 25 is configured to be releasably engaged with the at least one hold device 22. The at least one hold device 22 in the exemplary arrangement also comprises a pocket which bounds an interior area in which the protective textile device 25 may be positioned.

As can be appreciated in this exemplary arrangement of the jacket 21 the protective textile device 10 may be engaged with the member of the jacket that bounds the back side thereof. Further, in this exemplary arrangement the protective textile devices 24 and 25 may be positioned in the respective pockets on the right and left sides of the right and left members which form the front of the jacket. As can be appreciated in the exemplary arrangement in the closed position of the front sides of the jacket, the protective textile devices 24 and 25 are somewhat horizontally overlapping. In this exemplary arrangement this helps to assure that there is no gap between the protective textile devices when the front of the jacket is closed.

As can be appreciated the exemplary jacket 21 is configured so that it may be simultaneously worn in layered relation with one or more of the T-shirt 8, the long sleeve shirt 17 and the hooded pullover 19. Further in exemplary arrangements three or all four of these clothing items may be simultaneously worn by a person who utilizes an exemplary clothing system. Further as can be appreciated the user may choose to selectively include a respective protective textile item in engagement with a selected one of the clothing items. For example in some arrangements where a clothing item includes at least one hold device in the rear member that is engageable with the protective textile item 10, the user may engage item 10 with that particular clothing item to provide a barrier that protects the user's back. The user may then choose to wear the jacket 21 with the protective textile items 24 and 25 in engagement with the front members. This will provide protection for the user's front side while wearing the jacket. Of course it should be understood that this approach is exemplary and in other arrangements other approaches may be used.

These exemplary components and systems demonstrate examples of a few clothing items which may comprise clothing systems in which a plurality of clothing items may be simultaneously worn in layered relation. Further these exemplary clothing items and systems demonstrate how one or more protective textile items can be used in exemplary systems by being releasably engaged with a selected one of a plurality of clothing items through respective hold devices.

Further as can be appreciated the positioning of the protective textile items as well as the makeup thereof can be suitably configured to achieve different functions and also to provide those functions by being in overlying relation with different areas of the user's body.

For example exemplary arrangements may provide a system of outdoor clothing which may be used in widely varying environmental conditions. Such exemplary arrangements may also provide a clothing system which comprises workwear for individuals who must work in widely varying climate conditions. Further as can be appreciated the ability of the user to wear exemplary clothing items of the system individually or a plurality of such items simultaneously in outwardly overlying relation of the same human body portion provides options to adapt clothing systems to different work environments. Further as can be appreciated the exemplary clothing items may be configured to include an arrangement of pockets, such as stretchable pockets or other features that are suitable for containing, holding or engaging articles and structures as may be desirable under certain given circumstances.

Thus the exemplary arrangements described herein provide improved capabilities and operation, eliminate difficulties encountered in the use of prior devices and systems, and attain the useful results described herein. In the foregoing description, certain terms have been used for brevity, clarity and understanding. However, no unnecessary limitations are to be implied therefrom because such terms are used for descriptive purposes and are intended to be broadly construed. Moreover the descriptions and illustrations herein are by way of examples in the new and useful features and relationships are not limited only to the exact features and relationships that have been shown and described.

Further it should be understood that the features and/or relationships associated with one exemplary arrangement can be combined with features and/or relationships from another exemplary arrangement. That is, various features and/or relationships from various arrangements that have been described may be combined into further arrangements. The new and useful scope of the disclosure is not limited only to the arrangements shown and described herein.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. A system comprising:

a protective textile item, a plurality of clothing items, wherein each clothing item is configured to be worn separately from each of the other clothing items as well as simultaneously in outward overlying relation of the same human body portion in layered relation with at least one of the other clothing items, wherein each clothing item includes a respective member integrally formed in the respective clothing item, wherein the member includes at least one hold device, wherein the at least one hold device is configured to releasably hold the protective textile item in engagement with the member when the clothing item is worn separately from each of the other clothing items as well as when the closing item is worn simultaneously with at least one of the other clothing items, wherein the protective textile item is configured to be released from engagement with the respective at least one hold device of the respective member of a first clothing item, and then engaged with the respective at least one hold device of the respective member of the second clothing item different from the first clothing item, wherein the first and second clothing items are wearable simultaneously with the protective textile item attached to either the respective member of the first clothing item or the respective member of the second clothing item.

2. The system according to claim 1 wherein the plurality of clothing items includes a third clothing item, wherein the third clothing item includes a respective member integrally formed in the third clothing item and a respective at least one hold device configured to releasably hold the protective textile item in engagement with the respective member when the third clothing item is worn separately from each of the other clothing items as well as when the third clothing item is worn simultaneously with at least one of the other clothing items, wherein the first, second and third clothing items are wearable simultaneously in overlying relation of the same human body portion and with the protective textile item attached to either the respective member of the first clothing item, the second clothing item or the third clothing item.

3. The system according to claim 1 wherein the protective textile item comprises a stab resistant material.

4. The system according to claim 1 wherein the protective textile item comprises a bullet resistant material.

5. The system according to claim 1 wherein the protective textile item comprises a waterproof material.

6. The system according to claim 1 wherein the protective textile item comprises a windproof material.

7. The system according to claim 1 wherein the protective textile item comprises a heat generating material.

8. The system according to claim 1 wherein the protective textile item comprises a radiation reflecting material.

9. The system according to claim 1 wherein at least one respective hold device comprises a hook and loop fabric fastener.

10. The system according to claim 1 wherein at least one respective hold device comprises a press stud.

11. The system according to claim 1 wherein at least one respective hold device comprises a magnet.

12. The system according to claim 1 wherein at least one respective hold device comprises a zipper.

13. The system according to claim 1 wherein at least one respective hold device comprises a pocket configured to receive at least a portion of the protective textile item.

14. The system according to claim 1 wherein at least one respective hold device comprises a pocket on an inside surface of the respective member configured to receive at least a portion of the protective textile item.

15. The system according to claim 1 wherein at least one respective hold device comprises a pocket configured to receive at least a portion of the protective textile item, wherein at least a portion of the pocket is comprised of a stretch fabric.

16. The system according to claim 1 wherein at least one respective hold device of the first clothing item comprises a pocket configured to receive therein at least a portion of the protective textile item, and wherein the at least one respective hold device of the second clothing item comprises at least one of a hook and loop fabric fastener, a press stud, a magnet, and a zipper.

17. The system according to claim 1 wherein the respective at least one hold device comprises a pocket configured to receive and hold the protective textile item internally within the pocket, wherein in a generally flat position of the respective member which includes the pocket, the pocket has a generally rectangular interior area, wherein in a generally flat position of the protective textile item, the protective textile item is generally rectangular and is configured to be fully housed within the pocket, and includes at least one of a rounded corner portion, an angled corner portion.

18. A system comprising:

a protective textile component, a plurality of clothing items, wherein each of the plurality of clothing items is configured to be worn in outward overlying relation of a same human body portion, and to be worn separately from each of the other clothing items, and wherein at least two of the clothing items are configured to be worn simultaneously in layered relation, wherein each of the plurality of clothing items includes at least one respective hold device, wherein the respective at least one hold device of a respective clothing item is configured to hold the protective textile component in releasable engagement with the respective clothing item while the respective clothing item is being worn, wherein each respective at least one hold device is configured to releasably hold the protective textile component in engagement with any respective one of the at least two simultaneously worn clothing items while the at least two clothing items are simultaneously being worn in overlying relation of the same body portion.

19. The system according to claim 18 wherein the plurality of clothing items includes at least three clothing items that are simultaneously wearable in overlying relation of the same human body portion, wherein the protective textile component can be in respectively engaged relation with any respective one of the at least three clothing items while the at least three clothing items are being simultaneously worn.

20. A system comprising:

at least one protective textile component, a plurality of clothing items, wherein each of the clothing items is configured to outwardly overlie the same human body portion, is configured to be worn separately of each of the other clothing items and simultaneously in layered relation with at least one of the other clothing items, and includes a respective at least one hold device in operative connection with the respective clothing item, wherein each respective at least one hold device is configured to releasably hold one of the at least one protective textile component in releasable engagement with a respective clothing item, wherein the one protective textile component is configured to be worn in engagement with the respective at least one hold device of any respective one of at least two simultaneously worn clothing items while such items are simultaneously worn in overlying relation of the same body portion.

* * * * *